US008650889B2

(12) United States Patent
Hempstead et al.

(10) Patent No.: US 8,650,889 B2
(45) Date of Patent: Feb. 18, 2014

(54) TURRET SUBASSEMBLY FOR USE AS PART OF A CRYOSTAT AND METHOD OF ASSEMBLING A CRYOSTAT

(75) Inventors: Martin Howard Hempstead, Oxon (GB); Stephen Paul Trowell, Louth (GB)

(73) Assignee: Siemens Plc, Frimley, Camberley, Surrey (GB)

( * ) Notice: Subject to any disclaimer, the term of this patent is extended or adjusted under 35 U.S.C. 154(b) by 1192 days.

(21) Appl. No.: 12/441,113

(22) PCT Filed: Sep. 13, 2007

(86) PCT No.: PCT/GB2007/050538

§ 371 (c)(1),
(2), (4) Date: Mar. 12, 2009

(87) PCT Pub. No.: WO2008/032117

PCT Pub. Date: Mar. 20, 2008

(65) Prior Publication Data

US 2010/0043454 A1 Feb. 25, 2010

(30) Foreign Application Priority Data

Sep. 15, 2006 (GB) ..... 0618141.6

(51) Int. Cl.
*F25B 19/00* (2006.01)
*F17C 7/04* (2006.01)
*F17C 3/10* (2006.01)

(52) U.S. Cl.
USPC ..... 62/51.1; 62/48.1; 62/48.2

(58) Field of Classification Search
USPC ..... 62/51.1, 47.1, 45.1, 48.1, 48.2, 335
See application file for complete search history.

(56) References Cited

U.S. PATENT DOCUMENTS

| | | | | | |
|---|---|---|---|---|---|
| 4,620,886 | A | | 11/1986 | Wincierz et al. | |
| 4,841,268 | A | | 6/1989 | Burnett et al. | |
| 5,302,928 | A | * | 4/1994 | Laskaris et al. | 335/216 |
| 5,339,650 | A | * | 8/1994 | Hakamada et al. | 62/51.1 |
| 5,586,437 | A | * | 12/1996 | Blecher et al. | 62/47.1 |
| 5,638,685 | A | * | 6/1997 | Inaguchi et al. | 62/6 |
| 5,686,876 | A | * | 11/1997 | Yamamoto et al. | 335/216 |
| 5,884,489 | A | * | 3/1999 | Retz et al. | 62/51.1 |
| 6,005,461 | A | * | 12/1999 | Murray et al. | 335/216 |
| 6,109,042 | A | * | 8/2000 | Woods et al. | 62/51.1 |

(Continued)

FOREIGN PATENT DOCUMENTS

| | | | | |
|---|---|---|---|---|
| EP | 0 797 059 | A2 | 9/1997 | |
| EP | 0905524 | A1 * | 9/1998 | G01R 33/38 |

(Continued)

OTHER PUBLICATIONS

Chinese Office Action dated Mar. 16, 2011 (five (5) pages).

(Continued)

*Primary Examiner* — Frantz Jules
*Assistant Examiner* — Webeshet Mengesha
(74) *Attorney, Agent, or Firm* — Crowell & Moring LLP

(57) ABSTRACT

A turret subassembly for use as part of a cryostat, the turret subassembly comprising a vent tube (32) housing an auxiliary vent (40); a refrigerator sock (34) for housing a refrigerator; a termination box (30) linking the vent tube and the refrigerator sock, and having an opening (52) in one wall (54); and means (38) for attachment of the turret subassembly to a cryogen vessel (12).

22 Claims, 5 Drawing Sheets

(56) References Cited

U.S. PATENT DOCUMENTS

| | | | | |
|---|---|---|---|---|
| 2004/0194473 | A1* | 10/2004 | Daniels | 62/6 |
| 2004/0239462 | A1 | 12/2004 | Nemoto et al. | |
| 2006/0137363 | A1* | 6/2006 | Carr et al. | 62/47.1 |
| 2006/0207265 | A1* | 9/2006 | Sorsby | 62/47.1 |

FOREIGN PATENT DOCUMENTS

| | | | | | |
|---|---|---|---|---|---|
| GB | 2 212 983 | A | | 8/1989 | |
| GB | 2386676 | | * | 9/2003 | F17C 13/00 |
| GB | 2 395 545 | A | | 5/2004 | |
| GB | 2 431 462 | A | | 4/2007 | |
| JP | 60-59041 | U | | 4/1985 | |
| JP | 61-222209 | A | | 10/1986 | |
| JP | 61222209 | | * | 10/1986 | H01F 7/22 |
| JP | 63-211606 | A | | 9/1988 | |
| JP | 4-306472 | A | | 10/1992 | |
| JP | 4-370983 | A | | 12/1992 | |
| JP | 8-78737 | A | | 3/1996 | |
| JP | 2002-270913 | A | | 9/2002 | |
| WO | WO 2005/116516 | A1 | | 12/2005 | |

OTHER PUBLICATIONS

International Search Report dated Jan. 21, 2008 (Form PCT/ISA/210) including Form PCT/ISA/220 and Form PCT/ISA/237 ( Eleven (11) pages).

British Search Report dated May 24, 2007 (Two (2) pages).

British Combined Search and Examination Report under Sections 17 & 18(3) dated Dec. 14, 2006 (Two (2) pages).

British Examination Report under Section 18(3) dated May 25, 2007 (Three (3) pages).

British Search Report dated Dec. 13, 2006 (One (1) page).

English translation of Japanese Notice of Reasons for Refusal dated Jun. 19, 2012 (six (6) pages).

* cited by examiner

TURRET SUBASSEMBLY FOR USE AS PART OF A CRYOSTAT AND METHOD OF ASSEMBLING A CRYOSTAT

The present invention relates to cryostat vessels for retaining cooled equipment such as superconductive magnet coils. In particular, the present invention relates to access arrangements for cryostat vessels, which enable electrical current leads to enter the cryostat vessel to supply current to the cooled equipment; venting arrangements allowing cryogen gas to escape from the cryostat, and providing access for refilling with cryogen when required; and turret arrangements for retaining refrigerators in thermal contact with the cryogen.

FIG. 1 shows a conventional arrangement of access turret, vent tube, current leads and refrigerator in a cryostat. A cooled superconducting magnet 10 is provided within a cryogen vessel 12, itself retained within an outer vacuum chamber (OVC) 14. One or more thermal radiation shields 16 may be provided in the vacuum space between the cryogen vessel and the outer vacuum chamber. Although it is known for a refrigerator 17 to be mounted in a refrigerator sock 15 located in a turret 18 provided for the purpose, towards the side of the cryostat, conventional arrangements have had the access turret 19 retaining the access neck (vent tube) 20 mounted at the top of the cryostat.

A negative electrical connection 21*a* is usually provided to the magnet 10 through the body of the cryostat. A positive electrical connection 21 is usually provided by a conductor passing through the vent tube 20.

For fixed current lead (FCL) designs, a separate vent path (auxiliary vent) (not shown in FIG. 1) is provided as a fail-safe vent in case of blockage of the vent tube.

The present invention aims to overcome or at least alleviate numerous identified disadvantages of the conventional design. The present invention aims to allow the access turret to be moved from the top of the system to the side, combined with the refrigerator turret. This provides reduced overall system height and offers benefits in ease of manufacture and reduction of scrap as will be described below. The conventional separation of the access turret and the refrigerator turret means that two separate access ports (holes) must be provided in the cryogen vessel. The present invention aims to reduce this to a single access port. This will simplify assembly of the cryogen vessel and reduce thermal influx to the cryogen vessel by reducing the number of thermal paths into the cryogen vessel. Each port needs to be sealed during final assembly of the cryostat by welding of the appropriate turret, and welding into position of vent tube 20 and refrigerator sock 15. Such welding, to thin-walled components, is difficult to achieve, and is the source of some manufacturing difficulties, reworking and scrap. The present invention also aims to eliminate the need for welding to thin-walled turrets during final assembly of the cryostat.

Electrical connections have conventionally been provided to superconducting magnets within cryostats as follows. Referring briefly to FIG. 4, one connection, typically the negative connection 21*a* is made through the body of the cryogen vessel 12. This is typically done by bolting or soldering a flexible current lead to the base of the vent tube 20. The other connection 21 has been made by passing current through a conductive auxiliary vent 40 which is arranged in the access neck 20. A flexible positive current lead 21 is typically soldered or bolted to the auxiliary vent 40 during final assembly of the cryostat, to electrically connect the auxiliary vent to the magnet. The auxiliary vent 40 is typically arranged to be cooled by escaping cryogen gas, and is at least partially sealed by a burst disk, not shown, well known to those skilled in the relevant art.

A disadvantage of the conventional termination configuration is that the contact resistances of the joints between the flexible current leads 21, 21*a* and the vent tube 20 and auxiliary vent 40 dissipate heat at the base of the vent tube 20 within the cryogen vessel 12. This raises the temperature of adjacent cryogen gas during ramping, through conduction and convection of cryogen gas in the cryogen vessel. Typically, existing systems are intended to operate with cryogen vessel gas temperatures of order 5 K for typical liquid helium cryogen. Variance in contact resistance at the point where flexible leads 21, 21*a* from the magnet are connected to vent tube 20 and auxiliary vent 40 causes power dissipation during ramping, and far higher cryogen gas temperatures than intended, on some systems. This is known to result in excessive quenching frequency and a number of cryostat reworks. Higher stability outer coils are conventionally provided to compensate for this.

Returning to FIG. 1, the refrigerator 17 and the refrigerator turret 18 are usually both grounded. At least some of the negative return electrical current from magnet 10 will return through the body of the cryostat, the refrigerator turret and the refrigerator to ground. This has been found to be disadvantageous in that such currents, typically in the order of several hundred amperes, cause ohmic heating of the cryostat and the refrigerator. Depending on the design of the cryostat, the cryogen vessel 12 may also be heated by current flowing in the material of the cryogen vessel. This will cause heating of the cryogen vessel, resulting in problems such as reduced efficiency of refrigeration, increased cryogen consumption and possibly even magnet quench.

The present invention accordingly provides methods and apparatus as defined in the appended claims.

The above, and further, objects, characteristics and advantages of the present invention will become more apparent from consideration of the embodiments described below, given by way of examples only, together with the accompanying drawings, wherein.

Conventionally, the access turret 19 and refrigerator turret 18 are two separate entities which require two ports (holes) in the cryogen vessel 12 and some awkward welding and assembly operations, to assemble the respective turrets to the cryogen vessel. As discussed, this also leads to significant amounts of current flowing through the material of the cryostat and possibly also the refrigerator.

The present invention provides a turret sub-assembly replacing the conventional access turret and a refrigerator turret, which contains a vent tube and a refrigerator sock as well as provision for electrical connections to the magnet. The turret sub-assembly can be built and tested before being assembled as a single unit to the cryogen vessel. This provides a simpler more robust build sequence, being a feature of the invention. By testing the turret sub-assembly before assembly to the cryogen vessel, observed defects can be rectified, avoiding damage or scrap of the cryogen vessel in the case of a fault. The turret sub-assembly can be leak tested offline, before assembly to the cryogen vessel, reducing the risk of failure on the cryogen vessel when rectification is more difficult and expensive. Many of the formerly difficult assembly operations such as welding thin walled components are performed during manufacture of the turret sub-assembly, with a relatively simple process remaining for mounting the turret sub-assembly onto the cryogen vessel.

Figure 2:
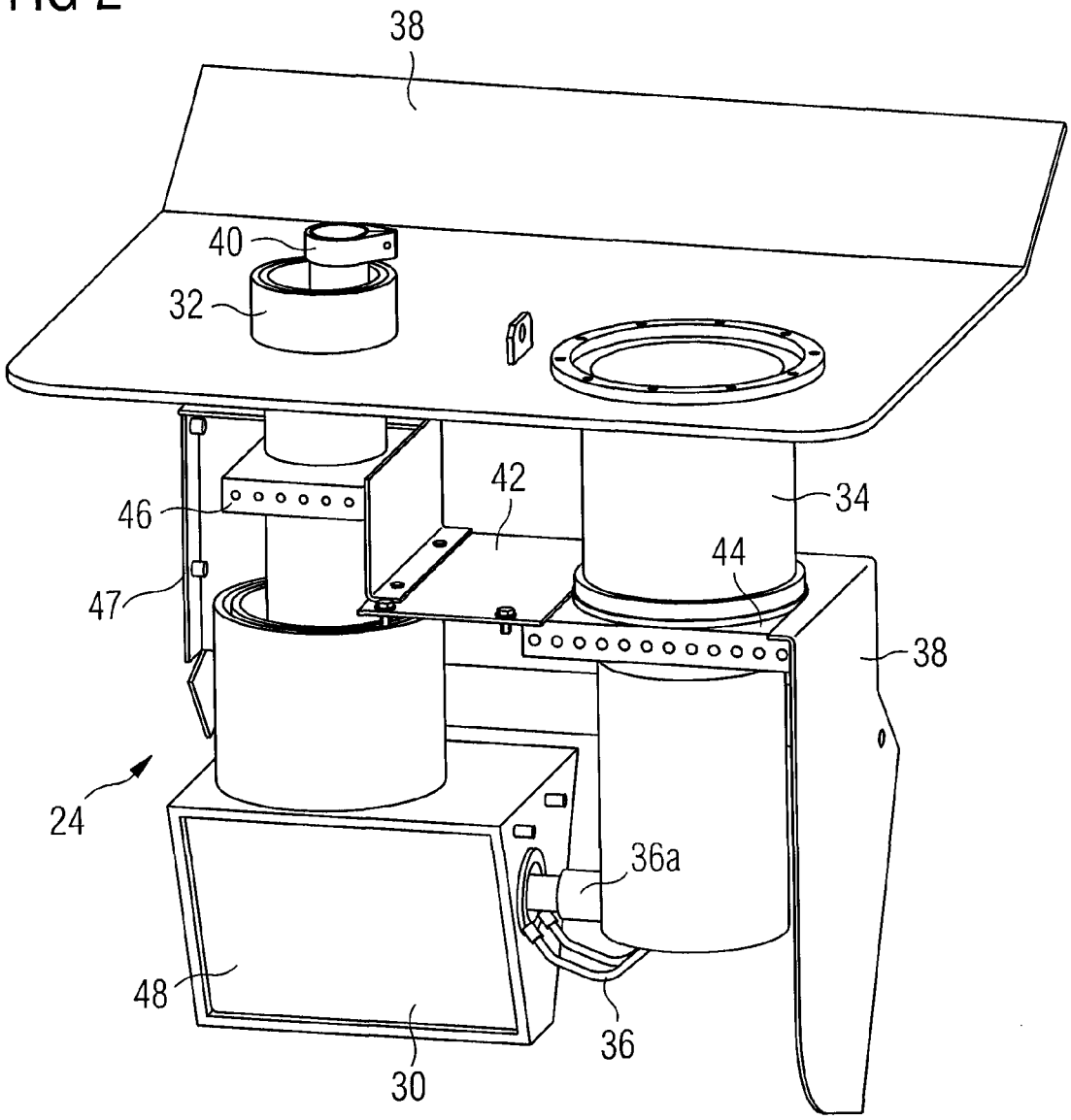
FIG. 2 shows a perspective view of a turret subassembly according to an embodiment of the present invention.

FIG. 2 illustrates a turret sub-assembly 24 according to an embodiment of the present invention. A feature of the invention is terminal box 30, which joins vent tube 32, refrigerator sock 34, and electrical current leads into a turret sub-assembly for connection to a cryogen vessel 12. An auxiliary vent 40 is provided substantially within vent tube 32. Electrical current leads 36 ensure that the flexible bellows 36*a* carries none of the negative return current discussed earlier. Various mounting flanges 38 are provided, to retain the various components in their correct relative positions and to provide a mechanical interface for attachment to the cryogen vessel, and the OVC.

Figure 3:
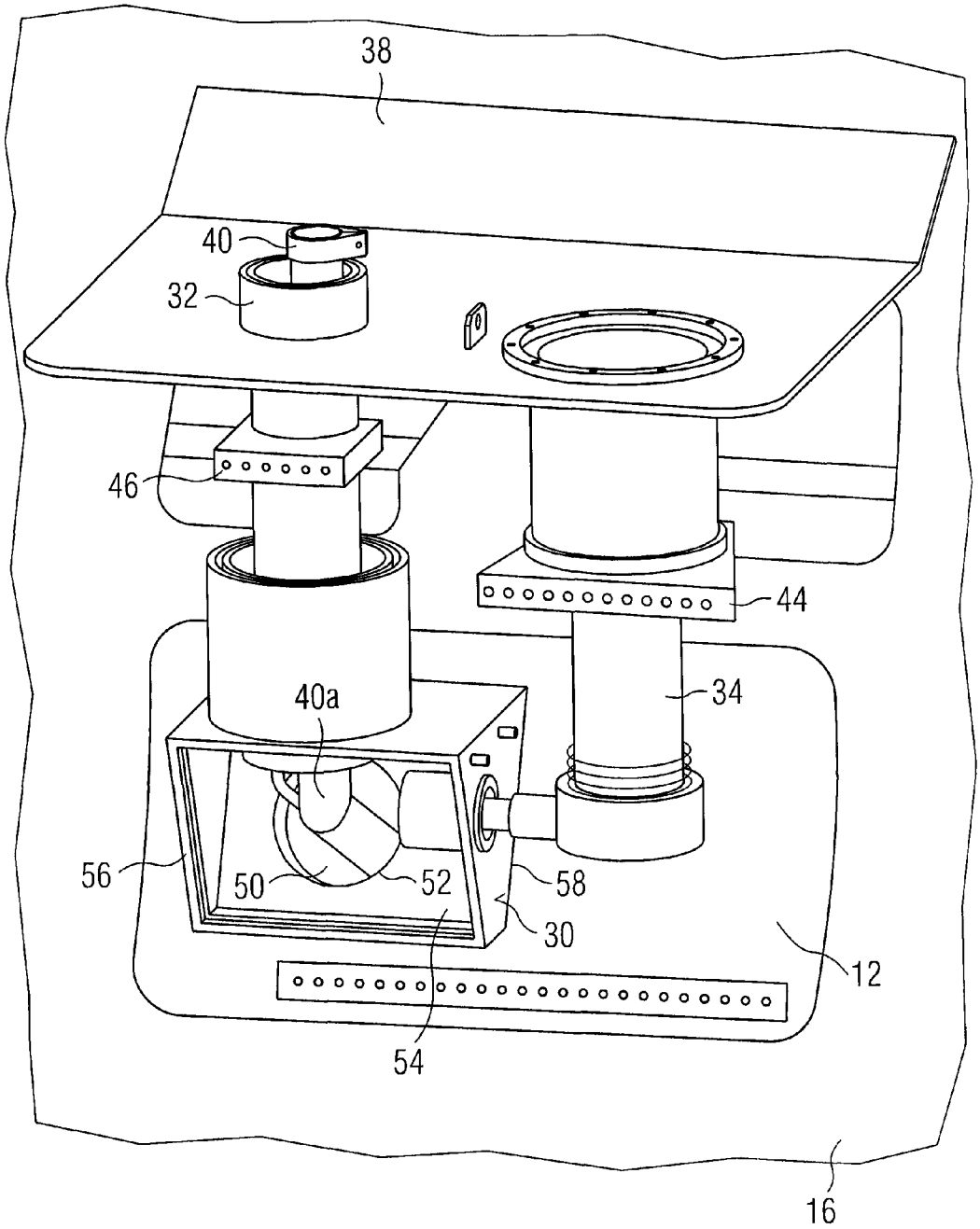
FIG. 3 shows a perspective view of a turret subassembly such as illustrated in FIG. 2 during mounting to a cryogen vessel.

The termination box 30 accordingly serves as a common interface between the vent tube 32, refrigerator sock 34 the cryogen vessel and the OVC. FIG. 3 shows a turret sub-assembly such as that illustrated in FIG. 2 assembled to a cryogen vessel 12. The termination box 30 has its cover removed, and the interior of the termination box is visible.

The turret sub-assembly 24 of FIG. 2 shows a refrigerator sock 34 arranged to accommodate a recondensing refrigerator to recondense cryogen vapour within terminal box 30. This allows the terminal box 30 to be partially flooded with liquid cryogen during operation, without affecting operation of the recondensing refrigerator. This provides effective local cooling, and reduces penetration of hot gas or heat conducted through the material of the vent tube 32 and refrigerator sock 34 into the cryogen vessel.

Particular advantages of the present invention flow from arrangement of electrical connections within the terminal box 30. As with conventional fixed current lead (FCL) designs, flexible current leads from the magnet must be terminated onto the fixed current leads of the vent tube 32 and auxiliary vent 40. As illustrated in FIG. 2, part of auxiliary vent 40 preferably serves as the positive current lead through the turret sub-assembly 24. The negative electrical connection may be made through the body of the cryogen vessel, as is conventional.

According to a preferred feature of the present invention, flexible current leads are joined to the auxiliary vent 40 and the vent tube 32. More preferably, these joints are located inside the termination box 30. This may be by any usual means such as bolting, soldering, welding, braising. Any heating caused by the resistive nature of the electrical connections between the flexible current leads and the auxiliary vent 40 and the vent tube 32 then takes place within the termination box 30. This heat is conducted to the refrigerator or taken by cryogen gas escaping through the vent tube 32 or auxiliary vent 40, or is absorbed in latent heat of evaporation of liquid cryogen partially flooding the termination box 30. Little of such heat will reach the cryogen vessel to heat the cryogen therein.

Figure 1:
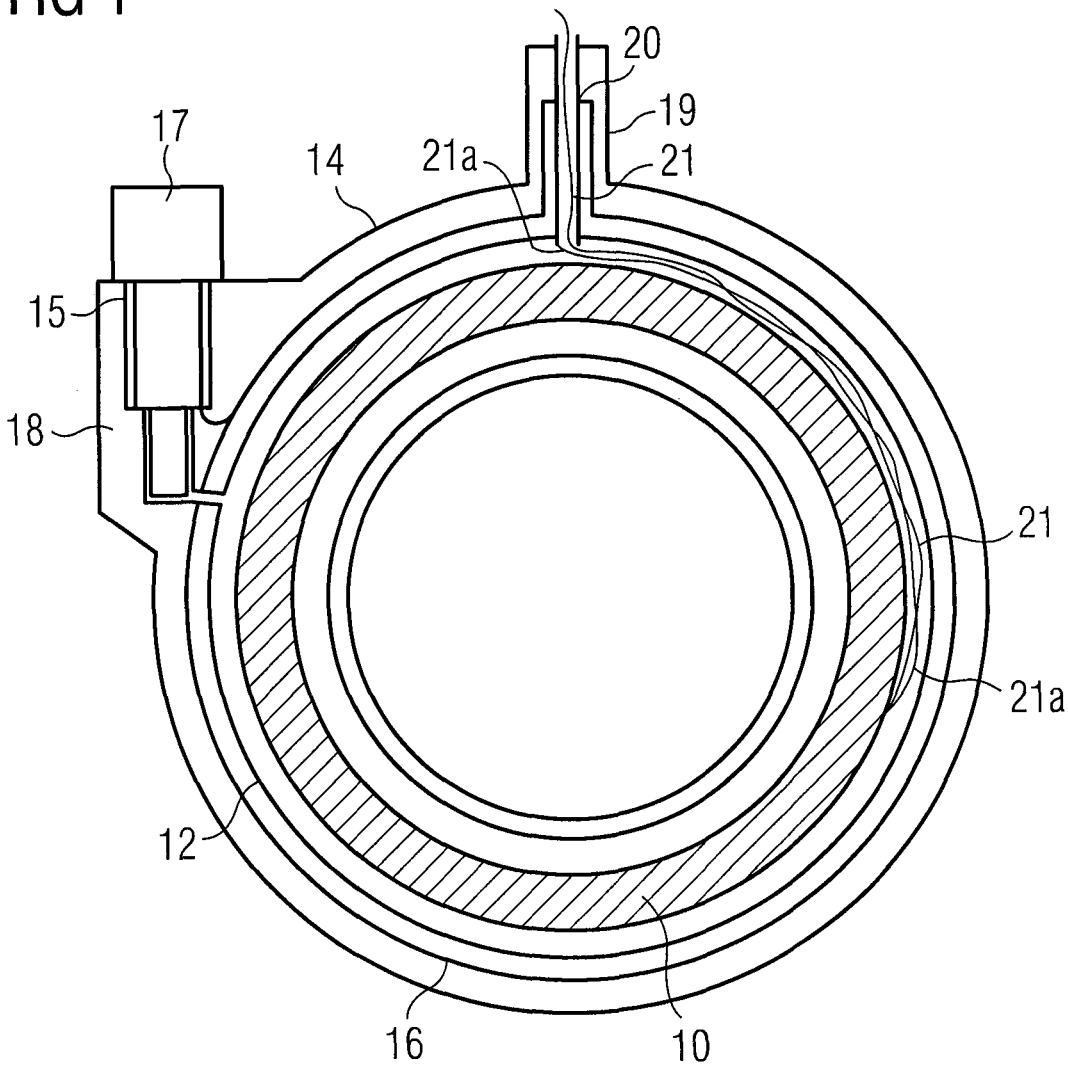
FIG. 1 shows a conventional arrangement of access turret, refrigerator turret and current leads in a cryostat containing a superconducting magnet.

Since the negative current path is typically through the material of the cryostat, most of the negative return current passes through the material of the refrigerator sock 34 and vent tube 32. The close proximity of the refrigerator sock 34 to the negative current lead termination in the termination box 30 minimises the current flow through the cryogen vessel, reducing the heating effect on the cryogen vessel as compared with conventional arrangements such as shown in FIG. 1. This may be improved by using relatively thick material for plate 42 and the termination box 30.

In operation, the termination box 30 is preferably partially flooded with liquefied cryogen so as to cover the negative lead termination, thereby eliminating the negative lead connection as a source of heating to the cryogen gas in the cryogen vessel.

Conventional arrangements such as shown in FIG. 1 required relatively long flexible current leads 21, 21*a* to carry electrical current to the magnet from the access turret. The final position of such lead is uncontrolled in conventional designs and it is possible that this lead can touch a magnet coil, reducing the reliability of the magnet system as a whole. Such problems are reduced with the present invention, since access for the current leads to the vent tube 32 is provided nearer the lower portion of the cryogen vessel, where the flexible leads are conventionally attached to the magnet.

The arrangement of the present invention minimises the generation of warm gas in the cryogen vessel, enabling significant potential reductions in magnet wire costs with improvements in recondensing margin, that is, the required power of the recondensing refrigerator, and ease of assembly of the cryostat as a whole. The improved thermal environment during ramping could avoid the need for the known higher stability outer coils, conventionally provided to compensate for instabilities caused by heated gas in the cryostat. In turn, this has been determined to enable a cost saving of the order of GB£1000 (US $2000) per magnet assembly in superconducting wire costs for the outer coils.

Typically, the components illustrated in FIG. 2 are welded together, such as by TIG welding. Alternative assembly techniques, such as soldering, braising or adhesive bonding may be used as appropriate, with due care being taken to ensure appropriate mechanical strength, electrical and thermal conductivity of each joint.

According to an aspect of the present invention, all welding on thin walled components such as the vent tube 32 and the refrigerator sock 34 may be carried out during the build of the turret sub-assembly rather than during final assembly of the cryostat as is conventional. Such thin walled welds have caused problems in the past, often due to the difficulty of accessing the components when assembled onto the cryostat and the severe consequences of a failed weld on a completed cryogen vessel.

By combining the access turret 32 and refrigerator turret 34 into a single turret sub-assembly 24, the present invention enables a more robust manufacturing route, at least in that no welding of thin walled components is required during assembly to the cryogen vessel. The combination of the conventional access turret 19 and refrigerator turret 18 into a turret sub-assembly 24 provides better access to the thin walled components for welding and assembly operations. This means that the likelihood of a failed weld is reduced, and the consequences of such a failed weld are not as severe as in the conventional manufacturing route, as only the turret sub-assembly 24 need be re-worked, with no damage to the cryogen vessel.

Close coupling of the vent tube and refrigerator sock has a number of other advantages. As illustrated in FIGS. 2 and 3, a thermally conductive plate 42 is provided, linking a first stage 44 of the refrigerator sock to a thermal connection 46 to the material of the vent tube 32 and a thermal connection 47 to the material of the thermal shield. Plate 42 may be made relatively thick, as it need not be of the same structure as the wall of the cryogen vessel, as is typically the case with similar structures in conventional designs. In addition, the vent tube 32 and refrigerator sock 34 are relatively close together, so effective thermal conduction may be provided between the first stage 44 of the refrigerator sock and the vent tube. The plate 42 may form part of a thermal radiation shield 16 in the finished system. Cooling of the vent tube 32 is thereby maximised, removing heat travelling from the outer vacuum chamber, in use, toward the cryogen vessel before it reaches the cryogen vessel. This reduces the heat load on the cryogen vessel below that experienced using a conventional access turret 19.

As is well known to those skilled in the art, turret components such as vent tube 32 and refrigerator sock 34 represent paths for heat influx to the cryogen vessel. Such turret components are accordingly relatively high temperature components. The use of the turret sub-assembly 24 of the present invention, comprising termination box 30, serves to separate relatively high-temperature turret components from the cryogen vessel. This avoids a significant portion of the known problem of heating of cryogen gas in the cryogen vessel by thermal influx through the material of the turret components. This usefully enables cheaper magnet designs, since an equivalent cooling may be achieved with a less-powerful refrigerator. The reduced heating of the cryogen gas inside the cryogen vessel also reduces the likelihood of magnet quench.

Figure 6:
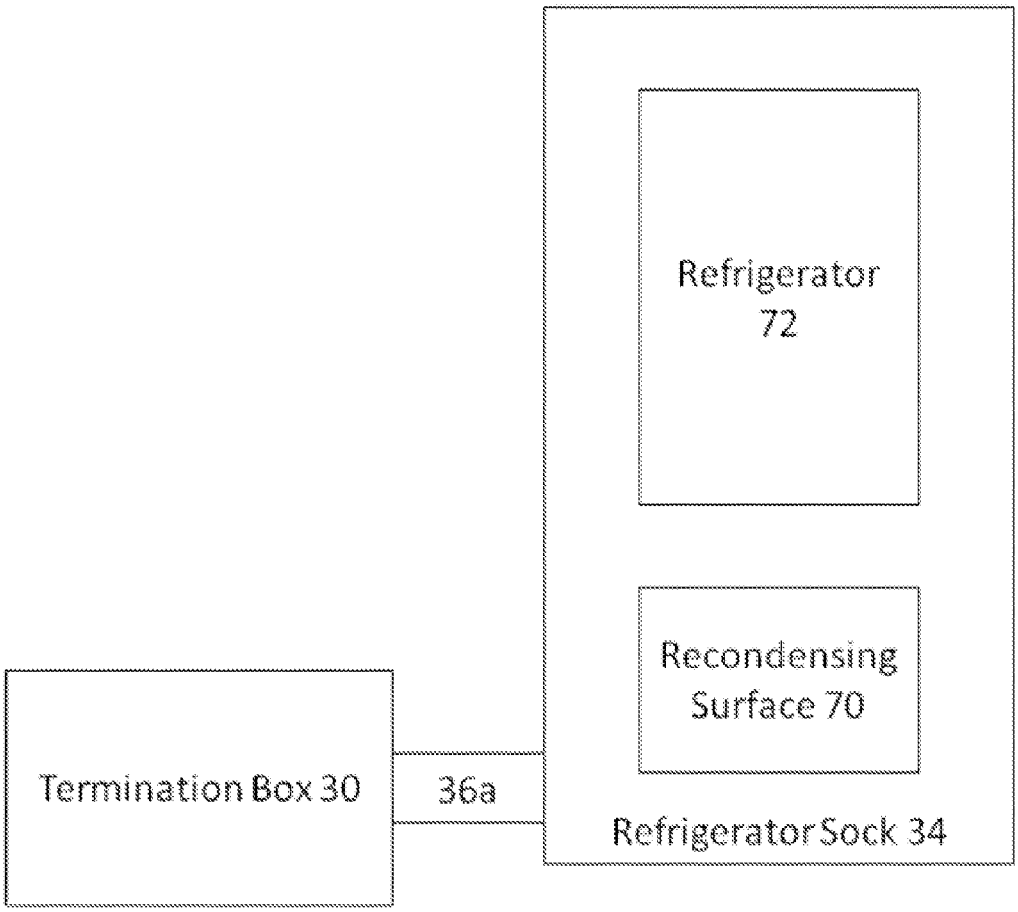
FIG. 6 is a highly schematic illustration of a refrigerator sock with a recondensing surface arranged to be cooled by a refrigerator and exposed to the interior of a termination box.

FIG. 6 is a highly schematic illustration of a refrigerator sock 34 with a recondensing surface 70 arranged to be cooled by a refrigerator 72 and exposed to the interior of the termination box 30.

Final Assembly to the Cryogen Vessel

A significant advantage provided by the present invention lies in the improved assembly method, particularly when joining the turret sub-assembly 24 comprising vent tube 32 and the refrigerator sock 34 to the cryogen vessel 12. As shown in FIG. 3, the termination box 30 is of sufficient dimensions to cover a corresponding, and preferably only, port (hole) 50 in the wall of the cryogen vessel 12. The termination box 30 has a hole 52 in one wall 54 which is aligned at least partially with the corresponding port 50 in the wall of the cryogen vessel 12. The termination box 30 is preferably at least substantially open on the side 56 opposite the wall 54 which is aligned with the port 50 in the cryogen vessel. This open side 56 allows easy access to the interior of the termination box 30, and the port 50 into the cryogen vessel. A cover 48 is provided to seal the open side 56 at the end of the assembly process.

As illustrated in FIG. 3, the turret subassembly is offered up to the cryogen vessel, with the hole 52 aligned with the port 50 into the cryogen vessel 12, through a suitable hole in thermal shield 16. Flanges 38 may be welded to the OVC to retain the turret subassembly firmly in place. Other flanges may be welded to the cryogen vessel. Fixture of flanges 38 provides mechanical support to the turret sub-assembly. Thermal shields such as shown at 16 may be connected by thermally conductive braids to refrigerator sock stage 44 and/or thermal connection 46. If required, an extension piece 40*a* may be welded or otherwise attached to the lower end of auxiliary vent 40 at this time. This extension piece 40*a* may serve an electrical function, as described in more detail below. The body of the termination box 30 is next attached, preferably welded to the cryogen vessel. This may be achieved by welding around the inside of the hole 52 in the wall 54 of the termination box, if the hole 52 is larger than the port 50 into the cryogen vessel. Alternatively, or in addition, the outer perimeter 58 of the termination box 30 may be welded to the cryogen vessel. Flanges 38 and termination box 30 are preferably constructed of thicker material than is used for the refrigerator sock 34 and vent tube 32, so that no welding to thin-walled components is required during this final assembly stage. To complete the mounting of the termination box, cover 48 is welded onto the open side 56 of the termination box 30 to seal the termination box. The interior volume of the termination box is exposed to the interior of the cryogen vessel, but is sealed in all other directions. In operation, the termination box effectively forms part of the cryogen vessel 12.

Final assembly is accordingly rendered far simpler than in the conventional arrangement wherein thin walled vent tube 32 and refrigerator sock 34 are welded into ports on the cryogen vessel, separately and in difficult welding operations. By contrast, the present invention requires only a single welding operation of relatively thick-walled components which are easily accessible through and/or around the termination box.

In the final assembly, both the vent tube with auxiliary vent and the refrigerator sock are located towards the side of the cryostat, rather than being located at the top. This enables the overall height of the system to be reduced and access to the refrigerator and vent tube is simplified, making servicing operations simpler. As will be described below, the present invention also provides advantages in location of, and access to, electrical connections to the magnet.

Advantages provided by the present invention include the following:

Relatively high temperature components such as turret and electrical connections are placed remote from the cryogen vessel, in the path of escaping cryogen gas, thereby reducing heat input to the cryogen vessel.

Close thermal coupling of the vent tube and the refrigerator sock improves cooling of the vent tube, requiring less cooling power from the refrigerator and hence improving the recondenser margin.

The electrical termination points of flexible leads can be welded or bolted, increasing reliability of the joints, and reducing the resistance of the joints which in turn reduces heat generation within the system.

By situating the flexible current lead terminations nearer to the bottom of the cryogen vessel, reduced lengths of uncontrolled flexible current leads are present in the cryogen vessel.

By providing for partial flooding the termination box, electrical connections of flexible current leads to the access turret and access tube may be contact cooled by liquid cryogen.

Coupling the access turret and refrigerator turret together in proximity to both positive and negative electrical terminations reduces current flow through the cryogen vessel. Conventionally, the negative earth point is located on the refrigerator turret 18 and the refrigerator itself is plugged in to the refrigerator turret and hence earthed, so current flows through all parts of the OVC, refrigerator and refrigerator turret.

By providing both positive and negative electrical connections in close proximity to grounded components such as the refrigerator and refrigerator sock, the current path through resistive elements is shortened and heat influx to the cryostat is reduced.

The final assembly process is lower risk, more repeatable and requires less time than existing design, since the turret sub-assembly is pre-tested, and the final assembly of the turret sub-assembly onto the cryogen vessel is a simple welding task. Only one port in the cryogen vessel needs to be sealed, as opposed to the two ports required in the conventional arrangement of separate refrigerator turret and access turret.

The relocation of both vent tube and refrigerator sock to the side of the cryostat improves access to these components for easier servicing. Such arrangement also enables simpler and smaller looks covers, improving the aesthetic appearance of the final system, and reducing patients' fear of the system by making it appear smaller.

Electrical Connections

For fixed current lead (FCL) designs, there is a requirement to extend magnet current leads from the magnet to the base of the vent tube. The body of the cryostat itself typically serves as the negative terminal. Conventionally, flexible current leads 21, 21*a* extend from the base of the magnet and is bolted to the base of the vent tube 20 and auxiliary vent 40, as shown for example in FIG. 4.

Figure 4:
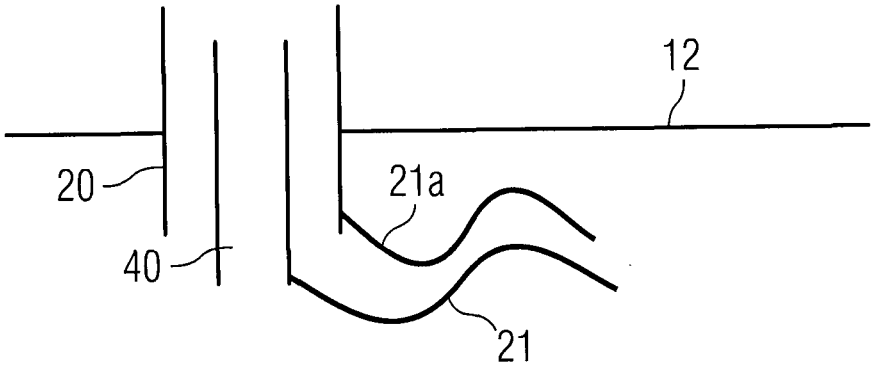
FIG. 4 shows a conventional arrangement of flexible current leads in a fixed current lead cryostat.

FIG. 4 shows a conventional arrangement for connecting electrical current leads to a superconducting magnet in a cryostat. Conventionally, at least part of the auxiliary vent 40 serves as a positive current lead through the access turret 19 and vent tube 20. A flexible positive current lead 21 is typically bolted or soldered to the base of the auxiliary vent 40. A flexible negative current lead 21*a* is typically bolted or soldered to the base of the vent tube 20.

A disadvantage of the conventional flexible lead termination arrangement as illustrated in FIG. 4 is that contact resistance at the bolted or soldered joints causes Joule heating and dissipation of heat at the base of the vent tube 20 during ramping, which raises the temperature of cryogen gas through conduction and convection in the cryogen vessel 12. The flexible current leads 21, 21*a* conduct the relatively high temperatures of the vent tube 20 (up to 90K at its base in the case of a helium system) into the cryogen vessel. These effects can ultimately lead to magnet quenching. Higher stability outer coils are conventionally required to compensate for this.

An aspect of the present invention provides an arrangement which combines the functionality of the auxiliary vent 40 and current leads to minimise the heat input to the cryogen vessel during ramping, reducing the likelihood of quench during operation and reducing risk of errors during assembly.

Figure 5:
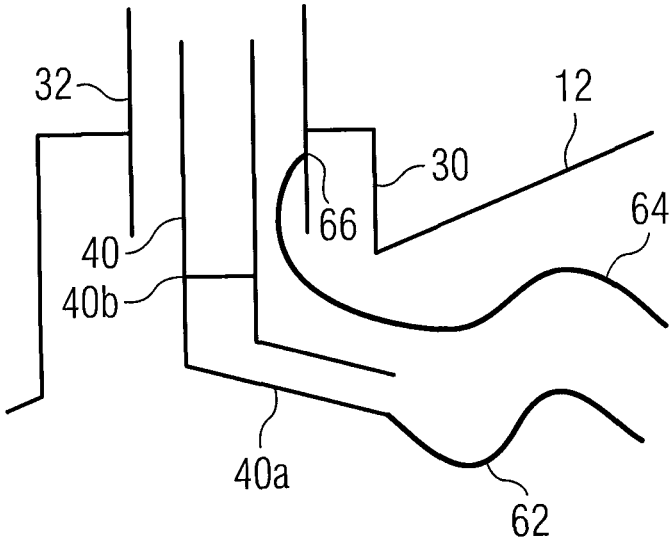
FIG. 5 shows an arrangement of flexible current leads in a fixed current lead cryostat according to an embodiment of the present invention.

An embodiment of the present invention illustrating this aspect is schematically shown in FIG. 5. A positive flexible current lead 62 from the magnet is soldered, bolted, braised or otherwise attached in an electrically conductive manner onto the end of an auxiliary vent extension piece 40*a*, which is preferably of a high purity metal and may be a copper tube, during assembly of the magnet within the cryogen vessel 12. This auxiliary vent extension piece 40*a* is later welded, soldered, bolted, braised or otherwise attached 40*b* in an electrically conductive manner to the auxiliary vent 40 of the turret subassembly of the present invention when the turret subassembly is offered up to the cryogen vessel during the final stages of the build. This conductive joint 40*b* connects the auxiliary vent extension piece 40*a* to the auxiliary vent 40, and hence the auxiliary vent extension piece 40*a* becomes integral to the auxiliary vent 40. In the illustrated embodiment, the auxiliary vent extension piece 40*a* extends into the cryogen vessel 12, unlike the auxiliary vent 40 itself, which is located within vent tube 32. The large surface area and high purity of material of the auxiliary vent extension piece 40*a* combine to minimise its electrical resistance, and so also to minimise heat generation in the cryogen vessel during current ramping. Contact resistances are less variable than for the existing designs, since connection of the flexible lead 62 to the auxiliary vent extension piece 40*a* may be done with full access to the required components. The inventors have shown this arrangement to provide reduced cryogen gas temperatures in the cryogen vessel enabling cheaper and/or more stable magnet design solutions.

In further contrast with conventional arrangements, the negative lead connection point 66 is displaced away from the interior of the cryogen vessel 12. Rather, the negative lead connection point 66 is exposed to a flow of cryogen gas up the vent tube 32 and auxiliary vent 40. The negative lead 64 may be connected to the vent tube 32, as shown in FIG. 5, or may be attached to a wall of the terminal box 30. The flow of cryogen gas carries any heat generated by current flowing through the resistive negative lead termination 66 during ramping away from the cryogen vessel 12. Any heated cryogen gas will vent through the vent tube 32 or auxiliary vent 40, and will not enter the cryogen vessel 12. Furthermore, the wall of the termination box 30 may be made significantly thicker than the wall of the cryogen vessel, since the termination box is relatively small and easy to fabricate from planar panels. A greater cross section of material is accordingly available to carry the current, and avoids resistive heating of the cryogen vessel, reducing the amount of heat generated during ramping.

The turret sub-assembly 24 with termination box 30 configuration of the present invention enables welding or other connection of a joint 40*b* joining the auxiliary vent extension piece 40*a* to the auxiliary vent 40 and bolting of the negative current lead at the relevant connection point 66 once the turret sub-assembly 24 has been mounted to the cryostat. Contact resistances for both positive and negative current leads are less variable than for conventional soldered designs.

Cryogen gas escaping from the cryogen vessel 12 passes through and around auxiliary vent 40 and its extension piece 40*a*, offering efficient cooling and removal of any heat generated by current flowing through the auxiliary vent and its extension piece.

In an alternative arrangement, the negative lead connection point is provided at an interface between the magnet former and the interior surface of the cryogen vessel, or with a short flexible lead to the interior surface of the cryogen vessel. In solenoidal-type arrangements, where the cryogen vessel is hollow cylindrical, the negative lead connection point may be provided on the interior surface of the cryogen vessel bore. Such embodiments are advantageous in that current flows through the material of the cryogen vessel and through the cryostat without direct warming of the cryogen gas. The negative lead connection point may even be arranged to be cooled by direct contact with liquid cryogen. Such improvements to the thermal environment of the coils during ramping become increasingly important when minimum cryogen inventory systems are considered. A secondary effect of such arrangements is that assembly of the access turret is simplified, where space is critical at the turret-cryogen vessel interface, as no negative lead connection need be established at that position. Such connection arrangements may be used independently of the positive connection arrangements employing the auxiliary vent described above, and independently of the turret subassembly of the present invention.

This aspect of the present invention accordingly provides a novel arrangement for the auxiliary vent and current lead assembly in fixed current lead access turret arrangements. The novel arrangement minimises the generation of warm gas in the cryogen vessel and combines the functionality of components, reducing cost and complexity. A simpler manufacturing process is enabled.

The present invention enables a low-cost fixed current lead (FCL) turret design, in turn enabling cheaper magnet designs which are more predictable in performance and less likely to require reworking during manufacture.

While the present invention has been described with particular reference to certain embodiments, it will be apparent to those skilled in the art that many variations of the described embodiments are possible, and remain within the scope of the invention as defined by the appended claims.

While specific reference has been made to helium cryogen, it will be apparent that any suitable cryogen may be used. References to "positive" and "negative" current leads, terminations and so on are used as convenient labels only, reflecting common practice in the art. Of course, the positive and negative electrical connections may be reversed, without departing from the scope of the present invention. If required, alternating voltages and currents may be applied to the described current leads, terminations and so on, without departing from the scope of the present invention.

The invention claimed is:

1. A turret subassembly for use as part of a cryostat, the turret subassembly comprising:

a vent tube housing an auxiliary vent;

a refrigerator sock for housing a refrigerator;

a termination box linking the vent tube and the refrigerator sock, and having an opening, wherein the termination box is provided with a removable wall portion opposite the opening; and means for attachment of the turret subassembly to a cryogen vessel.

2. A turret subassembly according to claim 1, wherein a recondensing surface, arranged to be cooled by the refrigerator housed within the refrigerator sock, is exposed to the interior of the termination box.

3. A turret subassembly according to claim 2, arranged such that, in use, recondensed liquid cryogen will at least partially flood the interior of the termination box.

4. A turret subassembly according to claim 1, arranged such that, once attached to the cryogen vessel, topmost parts of the vent tube and the refrigerator sock extend no higher than a topmost part of the cryostat.

5. A turret subassembly according to claim 1, arranged such that, once attached to the cryogen vessel, the interior of the termination box is exposed to the interior of the cryogen vessel through the opening.

6. A turret subassembly according to claim 1, wherein the refrigerator sock is fitted with first heat stage and a recondensing surface, the first heat stage being thermally connected to a thermal connection attached to the vent tube.

7. A turret subassembly according to claim 1, further comprising means for connection of electrical leads within the termination box.

8. A turret subassembly according to claim 7, wherein the means for connection comprise means for connecting a first electrical lead to the auxiliary vent within the termination box; and means for connecting a second electrical lead to the material of the termination box.

9. A cryostat comprising:

a cryogen vessel; and a turret subassembly comprising a vent tube housing an auxiliary vent;

a refrigerator sock for housing a refrigerator;

a termination box linking the vent tube and the refrigerator sock, and having an opening, wherein the termination box is provided with a removable wall portion opposite the opening; and means for attachment of the turret subassembly to the cryogen vessel, wherein the cryogen vessel is fitted with the turret subassembly wherein the removable wall portion is installed in position and welded to the termination box following assembly of the turret subassembly onto the cryogen vessel, to seal the termination box.

10. A cryostat according to claim 9, wherein the cryogen vessel contains cooled electrical equipment electrically connected to the means for connection.

11. A method of assembling a cryostat, comprising the steps of:

(a) assembling a turret subassembly comprising;

a vent tube housing an auxiliary vent;

a refrigerator sock for housing a refrigerator;

a termination box linking the vent tube and the refrigerator sock, and having an opening, wherein the termination box is provided with a removable wall portion opposite the opening, and the removable wall portion is installed in position and welded to the termination box following assembly of the turret subassembly onto the cryogen vessel, to seal the termination box; and means for attachment of the turret subassembly to a cryogen vessel;

(b) assembling a cryogen vessel, equipped with a port in the wall of the cryogen vessel;

(c) attaching the turret subassembly to the cryogen such that the port is sealed by the placement of the termination box, and such that the interior of the termination box is exposed to the interior of the cryogen vessel by means of the opening and the port.

12. A method of assembling a cryostat according to claim 11, further comprising, between step (a) and step (c), the step of testing the turret subassembly for manufacturing defects.

13. A method of assembling a cryostat according to claim 11, wherein the cryogen vessel contains cooled electrical equipment electrically connected to means for connection of electrical leads within the termination box by electrical leads passing through an aperture formed by the port and the opening.

14. A method of assembling a cryostat according to claim 11, wherein the cryogen vessel contains electrical equipment, the subassembly contains an electrical conductor and the method further comprises the steps of:

electrically and mechanically connecting a first flexible current lead from the electrical equipment to an extension piece prior to assembly of the cryogen vessel;

assembling a cryogen vessel, having an access port, around the electrical equipment;

passing the extension piece with attached flexible current lead, through the access port to the exterior of the cryogen vessel; and electrically and mechanically connecting the electrical conductor to the extension piece, so as to provide an electrical conduction path through the vent tube to the electrical equipment.

15. A method according to claim 14, wherein the method further comprises, in use, allowing cryogen gas to flow out of the cryogen vessel through the vent tube, cooling the electrical conduction path.

16. A method according to claim 15, wherein the electrical conductor and the extension piece, once mechanically connected, are arranged to serve as an auxiliary vent for carrying cryogen gas out of the cryogen vessel.

17. A method according to claim 14, further comprising the step of connecting a second flexible current lead to an interior surface of the vent tube.

18. A cryostat according to claim 10, wherein:

the cryogen vessel has an access port;

a first flexible current lead electrically and mechanically connects the electrical equipment to an extension piece; and the subassembly comprises a vent tube, containing an electrical conductor, attached to the cryogen vessel over the port, wherein the electrical conductor is electrically and mechanically attached to the extension piece, so as to provide an electrical conduction path through the vent tube to the electrical equipment.

19. A cryogen vessel containing electrical equipment according to claim 18, wherein the vent tube provides an escape path for cryogen gas to flow out of the cryogen vessel, thereby to cool the electrical conduction path.

20. A cryogen vessel containing electrical equipment according to claim 18, wherein the electrical conductor and the extension piece, mechanically connected, are arranged to serve as an auxiliary vent for carrying cryogen gas out of the cryogen vessel.

21. A cryogen vessel containing electrical equipment according to claim 18, further comprising a second flexible current lead connected to an interior surface of the vent tube.

22. A cryogen vessel containing electrical equipment according to claim 18, further comprising a second flexible current lead connected to an interior surface of the cryogen vessel.

* * * * *